US007490902B2

(12) United States Patent
Aubert

(10) Patent No.: US 7,490,902 B2
(45) Date of Patent: Feb. 17, 2009

(54) CHAIR

(75) Inventor: Thierry Aubert, Zurich (CH)

(73) Assignee: Girsberger Holding AG, Butzberg (CH)

( * ) Notice: Subject to any disclaimer, the term of this patent is extended or adjusted under 35 U.S.C. 154(b) by 379 days.

(21) Appl. No.: 11/268,018

(22) Filed: Nov. 7, 2005

(65) Prior Publication Data

US 2006/0097558 A1 May 11, 2006

(30) Foreign Application Priority Data

Nov. 9, 2004 (DE) ..... 10 2004 053 965

(51) Int. Cl.
*A47C 1/032* (2006.01)

(52) U.S. Cl. ..... 297/300.5; 297/300.2; 297/300.8; 297/303.4

(58) Field of Classification Search ..... 297/300.1, 297/300.2, 300.3, 300.5, 300.6, 302.1, 302.2, 297/302.4, 303.2, 303.4, 310, 316, 320, 344.12, 297/344.19, 344.22, 344.26, 354.1; 248/594, 248/598, 599, 600
See application file for complete search history.

(56) References Cited

U.S. PATENT DOCUMENTS 1,160,108 A * 11/1915 Hasty ..... 248/406.1
2,689,599 A * 9/1954 Mauser ..... 248/578
3,053,571 A * 9/1962 Fox ..... 297/301.4
3,185,430 A * 5/1965 Bernard ..... 248/578
3,206,153 A * 9/1965 Burke ..... 248/578
3,220,687 A * 11/1965 Baermann ..... 248/578
3,417,956 A * 12/1968 Helms ..... 248/576
3,455,601 A * 7/1969 Lie ..... 297/300.5
3,516,636 A * 6/1970 Burke ..... 248/578
3,720,396 A * 3/1973 Gilbert ..... 248/578
4,369,997 A * 1/1983 Desanta ..... 297/68
4,596,421 A * 6/1986 Schmitz ..... 297/316
5,348,371 A * 9/1994 Miotto ..... 297/303.2
5,462,336 A 10/1995 Desanta
2003/0151288 A1 * 8/2003 Deisig ..... 297/313

FOREIGN PATENT DOCUMENTS

DE 76 31 908 4/1978
DE 84 35 610.3 3/1985
DE 37 24 605 2/1989
WO WO 95/24845 9/1995
WO WO 96/29912 10/1996

* cited by examiner

*Primary Examiner*—David Dunn
*Assistant Examiner*—Patrick Lynch
(74) *Attorney, Agent, or Firm*—Volpe and Koenig, P.C.

(57) ABSTRACT

A chair (1), in particular a swivel office chair, is provided with a bottom chair part (2) having a column (3), a seat support (4) held on the bottom chair part (2), a seat (6) connected pivotably to the support, and a backrest support (5) holding a backrest (7) and connected pivotably to the seat support (4). The movement of the seat (6) is coupled with the movement of the backrest support (5) by a synchronizing mechanism having at least one spring (10) and coupling elements. The synchronizing mechanism is arranged essentially within the column (3).

10 Claims, 5 Drawing Sheets

CHAIR

BACKGROUND

The invention relates to a chair, in particular a swivel office chair, with a bottom chair part having a column, with a seat support held on the bottom chair part, a seat connected to this support so that it can pivot, and a backrest support holding a backrest and connected to the seat support so that it can pivot, wherein the movement of the seat is coupled with the movement of the backrest support by a synchronizing mechanism having at least one spring and coupling element.

For increasing comfort and for ergonomic sitting, swivel office chairs with synchronizing or rocking mechanisms are known, as described, for example, in EP 0 638 265 A2. This document involves a mechanism, which coordinates and simultaneously cushions the movement of the sitting surface and the backrest. In general, this mechanism part is housed underneath the seating surface in a so-called support. The cushioning is usually realized by coil springs, torque rods, or leaf springs. The restoring force can usually be set by the user.

Due to the complicated mechanism for the synchronous movement, the support is embodied as a relatively large, conspicuous box, which essentially defines the appearance of the chair and, among other things, negatively affects the handling. In addition, chairs with such a support are relatively heavy.

SUMMARY

Therefore, the object has arisen of creating a chair, which can be handled more easily, which has a lower weight, and whose synchronizing mechanism is inconspicuous.

To achieve this objective, the invention provides, in particular, that the synchronizing mechanism is arranged essentially within the column. Therefore, the essential parts of the synchronizing mechanism, especially its "active part," is not housed outside the column as before, but instead inside the column. By arranging the synchronizing mechanism within the column, the synchronizing mechanism is reduced in size overall and also the weight of the chair is reduced. As a whole, the synchronizing mechanism also includes the swivel points on the seat and back part and the active part includes, among other things, the synchronizing spring as an energy storage device, the locking device, and the adjustment device.

In a preferred embodiment, the coupling elements have a sleeve-shaped end of the seat support that engages in the upper end of the column, a plunger that receives force from the backrest support and preferably projects through the sleeve-shaped end of the seat support, and a connection element that connects the seat and the backrest support at a distance from the pivot bearing between the seat support and the backrest support in an articulated manner, and the synchronizing spring device receives force from the plunger and the lower free end of the seat support engages in the column.

When a load is placed on the seat, the synchronizing spring is biased via the seat support by the synchronizing mechanism, so that the adjustment force for moving the backrest changes accordingly. This is because the backrest support also contacts the plunger receiving force from the biased synchronizing spring. In particular, the sleeve-shaped end of the seat support engaging in the column and also the plunger descend to different depths in the upper column part according to the weight of a user, so that the synchronizing spring receives different force magnitudes and becomes compressed. Therefore, the synchronizing spring is biased more for heavier users than for light users, which affects the movement of the synchronizing mechanism accordingly. Therefore, the movement of the synchronizing mechanism is adapted practically automatically to the weight of the user, wherein the synchronizing mechanism can be moved relatively easily for light persons and for heavier users, more resistance acts against movement accordingly due to the greater biasing of the synchronizing spring.

The automatic weight adjustment allows manual biasing adjustment of the synchronizing spring to be eliminated if desired, thus enabling a very simple system.

The spring force of the synchronizing spring acts either directly on the backrest support and indirectly on the seat or vice versa. The plunger is activated either by the seat or preferably by the backrest support, wherein through the latter arrangement it is possible to transfer a greater percentage of force directly to the back.

For adjusting the height and/or the spring biasing of the chair according to the invention, advantageously the column has an upper column part with an adjustable spring and a lower column part arranged coaxial to the upper column part with a height-adjustment device, such that the two column parts are connected to each other so that they can rotate relative to each other and the rotation of the upper column part relative to the lower column part can be blocked by means of a locking device for height adjustment and can be released for adjusting the spring biasing. Here, the locking device is used to switch between a setting, in which the spring biasing is adjusted by rotating the upper column part relative to the remaining column and a setting, in which both column parts are coupled and the chair is adjusted in height due to rotation relative to the column base.

It is useful if the synchronizing spring device has at least one spring element supported on a preferably adjustable thrust support and if the spring element is formed preferably by a coil spring, optionally by at least one torsion spring, plastic spring, or gas spring. The spring element receiving force from the coupling elements can be arranged in the column such that by adjusting the thrust support in the axial direction of the column, the biasing of the spring element and thus its restoring force or the hardness of the spring effect on the seat and the backrest is adjusted. The adjustment of the thrust support can also be used for presetting the spring for a certain weight of a user of the chair or for a weight-dependent setting of the spring.

In particular, a coil spring can be housed with favorable spatial conditions in the column or in the upper column part, especially when the column has a round cross section. It is also advantageous that the spring force and the weight of the person act in the same direction.

If the spring biasing of the coil spring arranged between the coupling elements and the thrust support is to be adjusted, as already mentioned, the upper column part is rotated relative to the lower column part. The thrust support is locked in rotation with the upper column part and has a threaded bore hole, in which a threaded bolt locked in rotation with the lower column part engages. By rotating the threaded connection, the thrust support is adjusted in its height and thus the spring biasing is adjusted. The locking device is located in the released position for the adjustment of the spring biasing, so that the upper column part can rotate relative to the lower column part. For reducing friction during relative rotation, a bearing element like a thrust bearing can be provided between the facing ends of the upper column part and the lower column part.

For adjusting the height of the chair, the lower column part can rotate together with the upper column part relative to the column base. For this purpose, the chair has a column base, which extends at least partially into the lower column part and which has a threaded bar at its top end region. A threaded nut locked in rotation with the lower column part is screwed onto the threaded bar for adjusting the height of the chair. For adjusting the height, the locking device is located in the blocked position, that is, the upper column part is locked in rotation with the lower column part.

For adjusting the height and cushioning of the seat, a gas spring can also be provided. In this way, the gas spring performs a cushioning function and can also be adjusted in its active length for adjusting the height of the seat. The height adjustment of the seat can be performed in a known way by manual adjustment, for example, with the help of a control lever.

In an alternative embodiment, the chair has a column base, which is connected to a lower column part and also to a spring element arranged in the lower column part and formed by a gas spring. An upper column part connected to the seat support is provided with a spring located therein, which is supported on the bottom side by a thrust support connected to a piston rod of the gas spring and which receives force on the top side from the backrest support, especially by means of a plunger, and that the upper column part extends like a telescope at least partially into the inner cavity of the lower column part. This embodiment also enables a compact construction with a synchronizing mechanism housed essentially within the column.

Here, it is advantageous when the piston rod of the gas spring or a similar spring element is formed as a threaded bolt at least at its upper end or is connected to a threaded bolt and when the thrust support for the spring has a threaded bore screwed onto the threaded bolt. The spring biasing is adjusted by rotating the upper column part together with the thrust support for the spring relative to the threaded bolt at the upper free end of the lower spring element of the lower column part.

A reversed arrangement of the gas spring with a piston rod pointing downwards, which is supported on the column base with its bottom free end, is also possible. The thrust support is mounted on the gas cylinder of the gas spring pointing upwards.

The spring biasing of the synchronizing spring can be adjusted for downwards pointing piston rods, but also for the previously described, upwards pointing piston rods, not only by rotating the thrust support for the synchronizing spring relative to the gas spring, but also by adjusting the contact point of the synchronizing spring on the plunger guided within the upper column part and receiving force from the backrest support. Here, the plunger is provided with external threading, on which a plunger plate receiving force from the synchronizing spring is screwed.

For adjusting the spring biasing, the plunger can be turned by means of worm gearing that can be driven, for example, with a crank, a ratchet, or a handle, so that the plunger plate is adjusted vertically on the threading of the bolt and thus the synchronizing spring formed by a coil spring is compressed to a greater or lesser extent.

The plunger has a stop, whose bottom side exerts force on the top side of the upper column part.

For this embodiment, the synchronizing spring in the upper column part is also biased to different degrees by persons with different weights, whereby movement of the synchronizing mechanism or the backrest automatically adapted to the weight of the user is achieved.

The previously described type of biasing adjustment of the synchronizing spring in the region of the top plunger can also be provided for embodiments of the chair without a gas spring.

For a smaller overall height of the column, it is advantageous when the thrust support for the spring, preferably embodied as a coil spring, is a spring plate arranged offset downwards relative to its screw connection with the threaded bolt.

It is useful when the relative movement of the coupling elements of the synchronizing mechanism relative to each other can be blocked by means of a locking device and when the locking device can be adjusted between a released position and a locked position. In the blocked position of the locking device, the backrest and also the sitting surface can no longer be inclined, but instead only a common cushioning of the seating surface and the backrest relative to the bottom chair part is possible.

As already described in detail, the arrangement of the synchronizing spring device and the height adjustment is realized one above the other or at least partially one inside the other. When the seat support is loaded, the spring is biased more or less according to the weight of the user. By decoupling the synchronous movement, the backrest support activates the plunger in the column. Therefore, the spring, which equalizes the body weight of the user, is compressed. The chair according to the invention supports active rocking or can be locked in various positions if desired. Thus, the chair can be embodied so that the adjustment of the height and also the adjustment of the spring biasing can be activated by a switch element. The height is adjusted by swiveling the chair relative to the column base. By adjusting the spring biasing, the upper column part, including the spring plate, is turned on the threaded bolt and thus adjusted vertically. To adjust the height, a locking device is switched. Through the rotating movement of the column, a threaded nut is moved up and down on a threaded rod, which adjusts the height.

To increase the adjustment ease, a conventional gas spring can be used. The synchronizing spring now lies above the gas spring or surrounds it. The spring biasing is adjusted by means of swiveling the chair or by means of a hand-activation element in the form of a crank, a ratchet, or a handle.

BRIEF DESCRIPTION OF THE DRAWINGS

The invention is described in more detail below with reference to the drawings. In partially schematic representation, shown are.

DETAILED DESCRIPTION OF THE PREFERRED EMBODIMENTS

Figure 2:
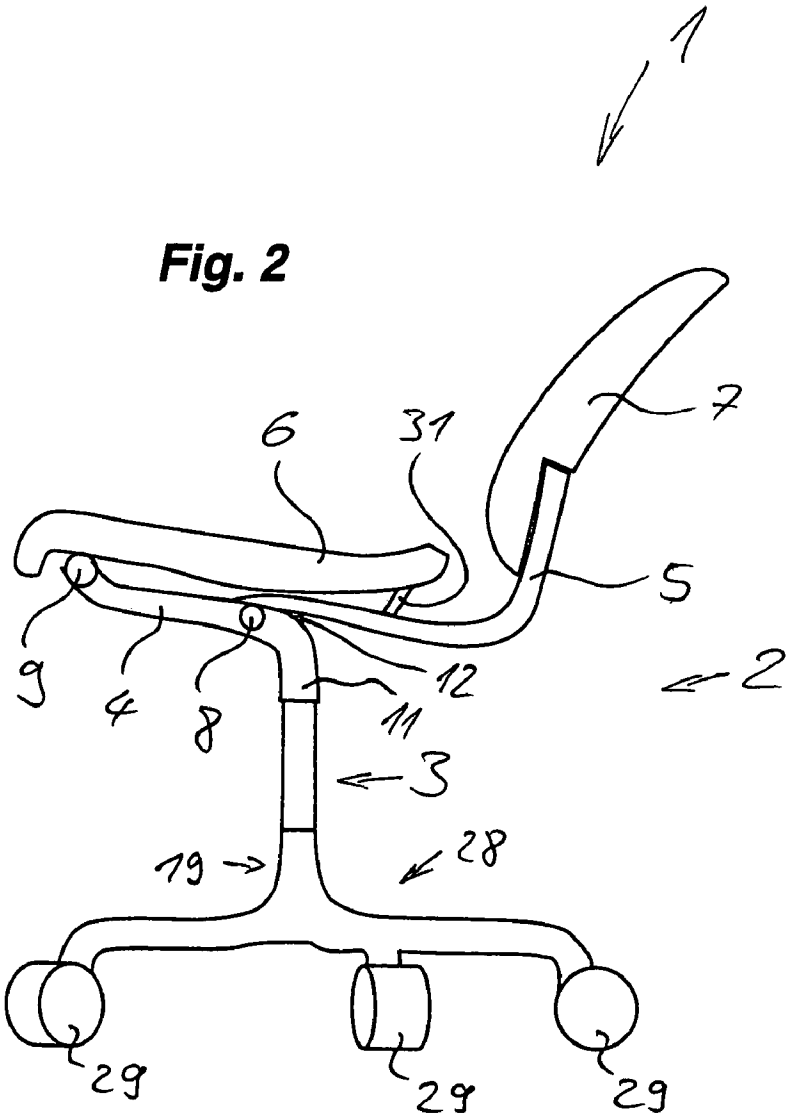
FIG. 2 is a side view according to FIG. 1 in a loaded position with an inclined sitting surface and a backrest inclined in sync with this surface.
Figure 1:
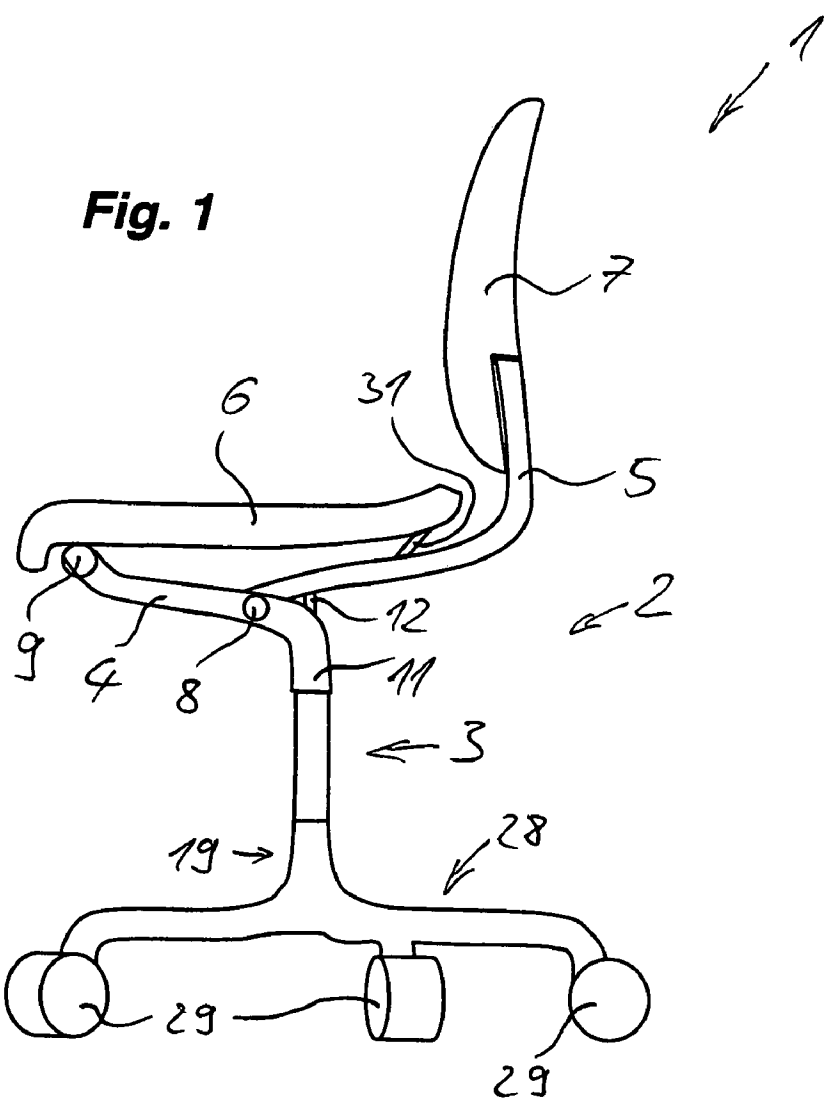
FIG. 1 is a side view of a chair according to the invention in the unloaded position.

A chair designated as a whole with 1, in particular a swivel office chair, is shown in FIG. 1 in an unloaded normal position and shown in FIG. 2 in an inclined, loaded position. It has a bottom chair part 2 with a column 3 and also a seat support 4 connected to the bottom chair part 2 and a backrest support 5 connected pivotably to the seat support 4. A seat 6 is connected pivotably to the seat support 4 by a pivot bearing 9. Furthermore, a pivot bearing 8 is arranged between the seat support 4 and the backrest support 5 at a distance to the pivot bearing 9. The backrest support 5 carries a backrest 7.

A synchronizing mechanism is provided for synchronous movement of the seat 6 and the backrest 7. This mechanism is used to coordinate and cushion the movement of the seat 6 and the backrest 7.

As can be seen in a preferred embodiment in FIGS. 3 to 6, the synchronizing mechanism has a spring 10 and also coupling elements, which are arranged within the column 3. The coupling elements are essentially formed by a bottom, sleeve-shaped end 11 of the seat support 4 projecting into the column 3, a plunger 12 receiving force from the backrest support 5 and preferably projecting through the sleeve-shaped end of the seat support 4, and a connection element 31 that can be seen in FIGS. 1 and 2 and that connects the seat 6 and the backrest support 5 set at a distance from the pivot bearing 8 between the seat support 4 and the backrest support 5 in an articulated way.

The spring device 10 for synchronous movement coupling receives force by means of the plunger 12 and by the lower free end 11 of the seat support 4 engaging in the column 3.

By means of the connection element 31, the seat 6 is inclined in sync with the backrest 7 in the corresponding inclination direction.

Figure 3:
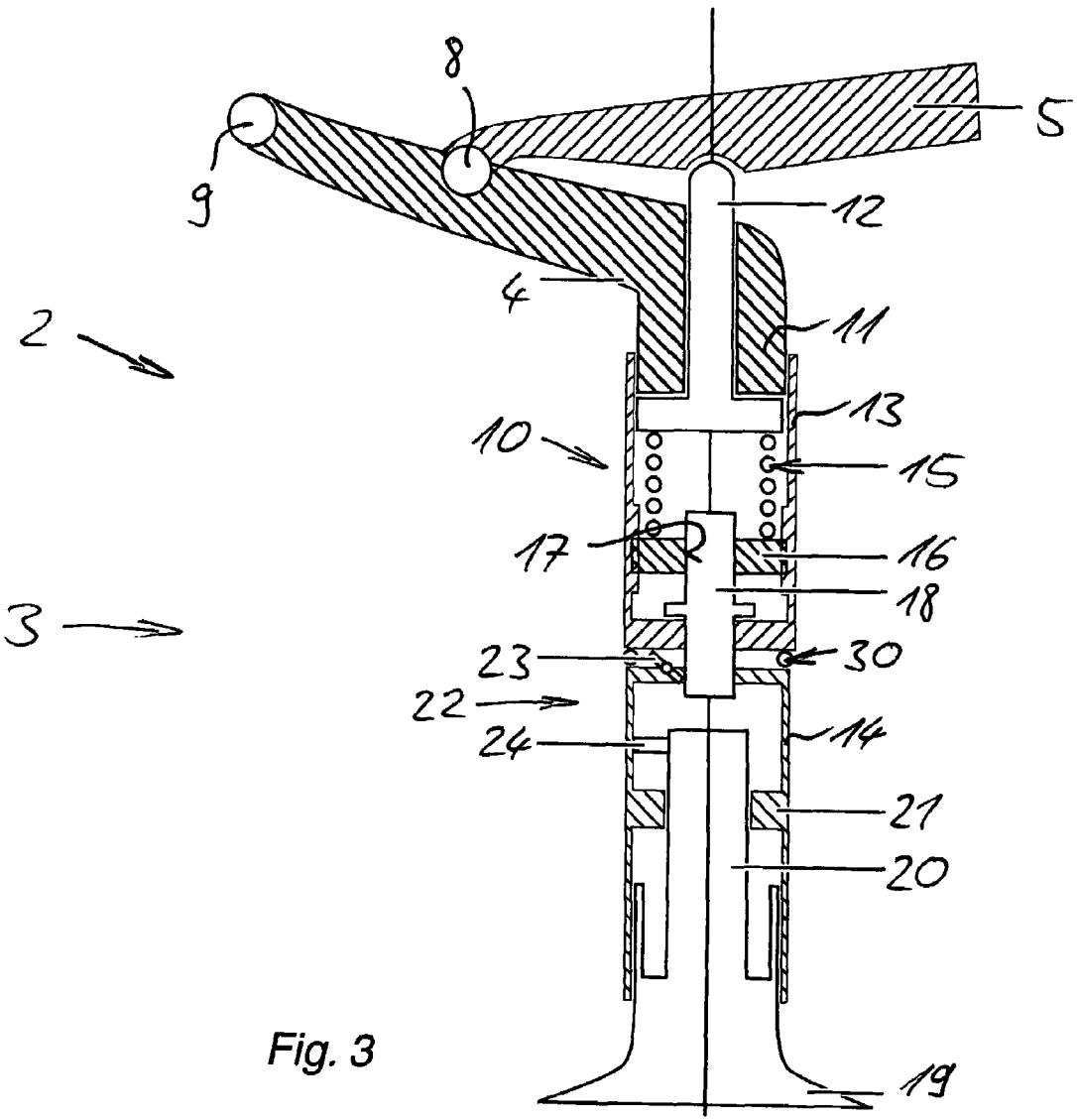
FIG. 3 is a longitudinal section view of a bottom chair part.
Figure 5:
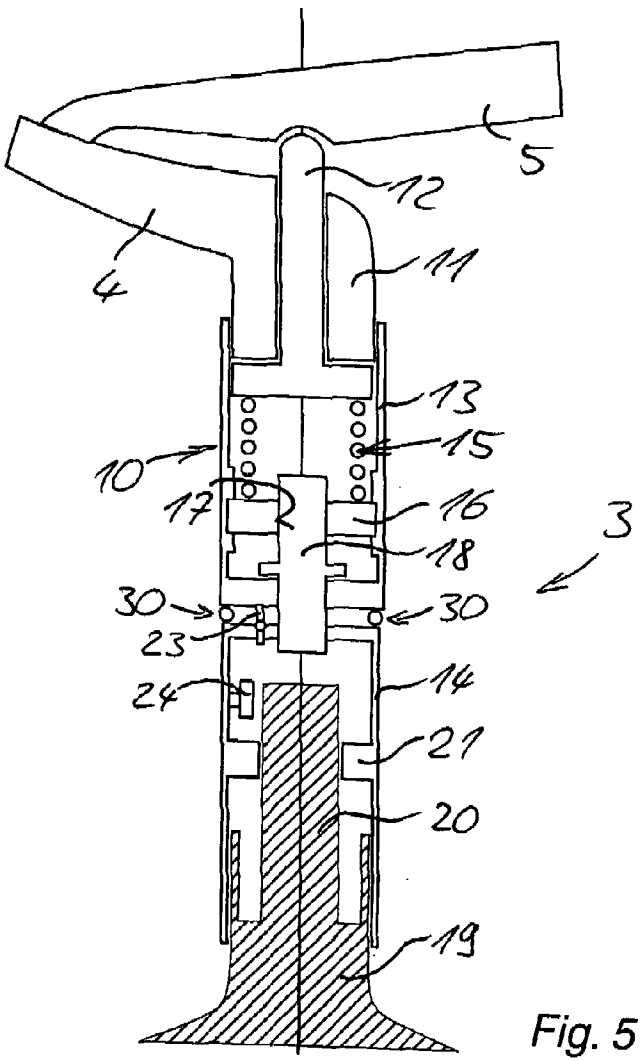
FIG. 5 is a side view according to FIG. 4 in a position for adjusting the height of the chair.
Figure 4:
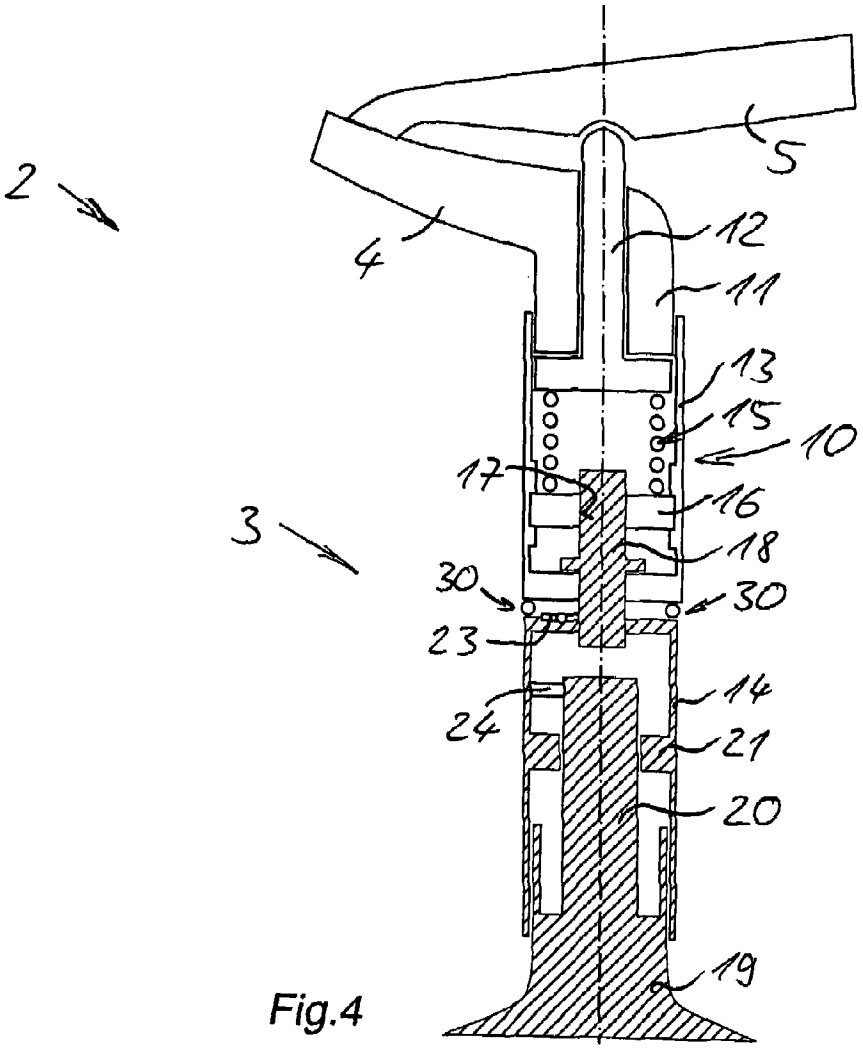
FIG. 4 is a side view of the bottom chair part in longitudinal section in a position for adjusting the spring biasing.

FIGS. 3 to 5 each show the bottom chair part 2 with a two-part column 3, which is formed from an upper column part 13 and a lower column part 14 arranged coaxial to the upper column part. In the upper column part 13, the synchronizing spring device 10 is arranged with a coil spring 15 as a spring element. The coil spring 15 is supported on a spring plate 16 adjustable in the coaxial direction to the upper column part 13 as a thrust support. The spring plate 16 is locked in rotation, but adjustable in height, with the upper column part 13 and has a threaded bore hole 17, in which a threaded bolt 18 locked in rotation with the lower column part 14 engages.

The guide of the spring plate 16 in the upper column part 13 is achieved by a groove. In the adjustment range, the upper column part 13 has a guide rail, which engages in the corresponding groove in the spring plate 16. Thus, the spring plate 16 can be displaced vertically and nevertheless remains connected to the upper column part 13. However, the spring plate 16 could also be guided by a tab in a slot in the upper column part 13.

If the upper column part 13 is rotated together with the spring plate 16 relative to the lower column part 14, the height of the spring plate 16 within the upper column part 13 is adjusted. With the adjustment of the height of the spring plate 16, the biasing of the coil spring 15 is changed.

The lower column part 14 has a column base 19, which extends at least partially into the lower column part 14 and has a threaded rod 20 on its top end. A threaded nut 21 locked in rotation with the lower column part 14 is screwed on the threaded rod 20. If the lower column part 14 is rotated relative to the column base 19, the threaded nut 21 also turns on the threaded rod 20, which adjusts the overall height of the chair 1.

In order to be able to select between the adjustment of the spring biasing by rotating the upper column part 13 relative to the lower column part 14 and also the adjustment of the chair height by rotating the lower column part 14 relative to the column base 19, a locking device 22 is provided. The locking device 22 blocks either the rotating of the two parts of the column 3 relative to each other with the help of a switch element 23 (as shown in FIG. 5), or the rotating of the lower column part 14 relative to the column base 19 with the help of a rotating lock device 24 (as shown in FIG. 4).

If the switch device 23 is in the blocked position and the rotating lock device 24 is in the released position, as FIG. 5 shows, the column 3 can be turned with both parts 13, 14 relative to the column base 19.

In contrast, if the switch device 23 is in the released position and the rotating lock device 24 is in the blocked position, as FIG. 4 shows, the upper column part 13 can be turned relative to the lower column part 14 with the column base 19. For easy rotating of both column parts 13, 14 relative to each other, a bearing element embodied as a ball thrust bearing 30 is arranged between both column parts 13, 14. Instead of the ball thrust bearing 30, the bearing element can also be embodied, for example, as a sliding bearing or a needle bearing.

Figure 6:
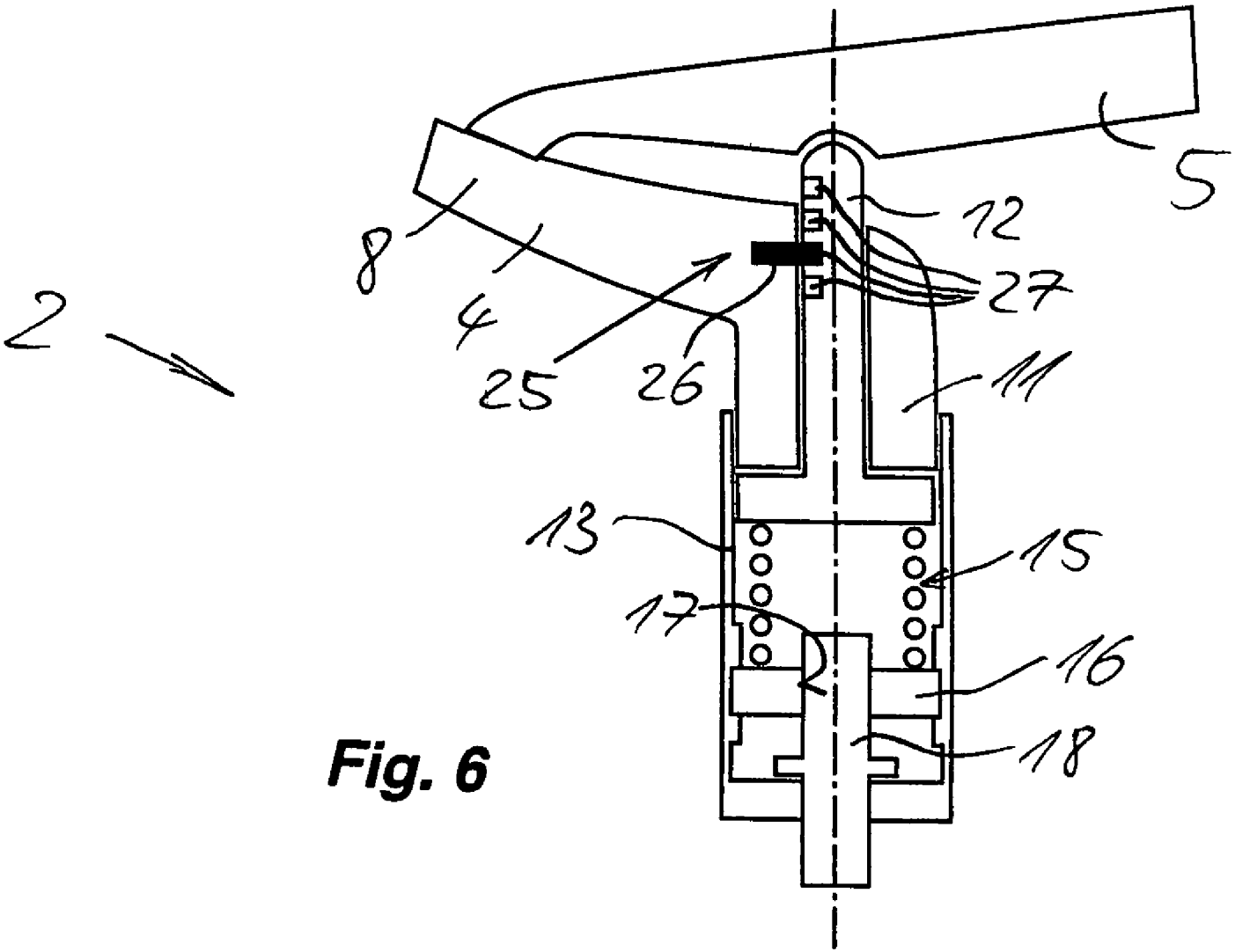
FIG. 6 is a side view of an upper column part with a locking device for locking the synchronous movement between a seat support and a backrest support.

FIG. 6 shows another possibility for adjusting the chair 1 according to the invention. For blocking the relative movement of the coupling elements of the synchronous movement relative to each other, a locking device 25 is provided, which can be adjusted between a released position and a locked position. In the locked position, which is shown in FIG. 6, the bottom, sleeve-shaped end 11 of the seat support 4 projecting into the column 3 is rigidly coupled with the plunger 12 and no synchronous inclination between the seat 6 and backrest 7 is possible, but instead only a common cushioning of these two elements. As can be seen in FIG. 6, the locking device 25 has a tab 26, which can engage in recesses 27 arranged at various heights in the plunger 12, whereby the (fixed) inclination of the backrest 7 relative to the seat 6 in the locked position of the locking device 25 can be adjusted.

Figures 7, 8, 9:
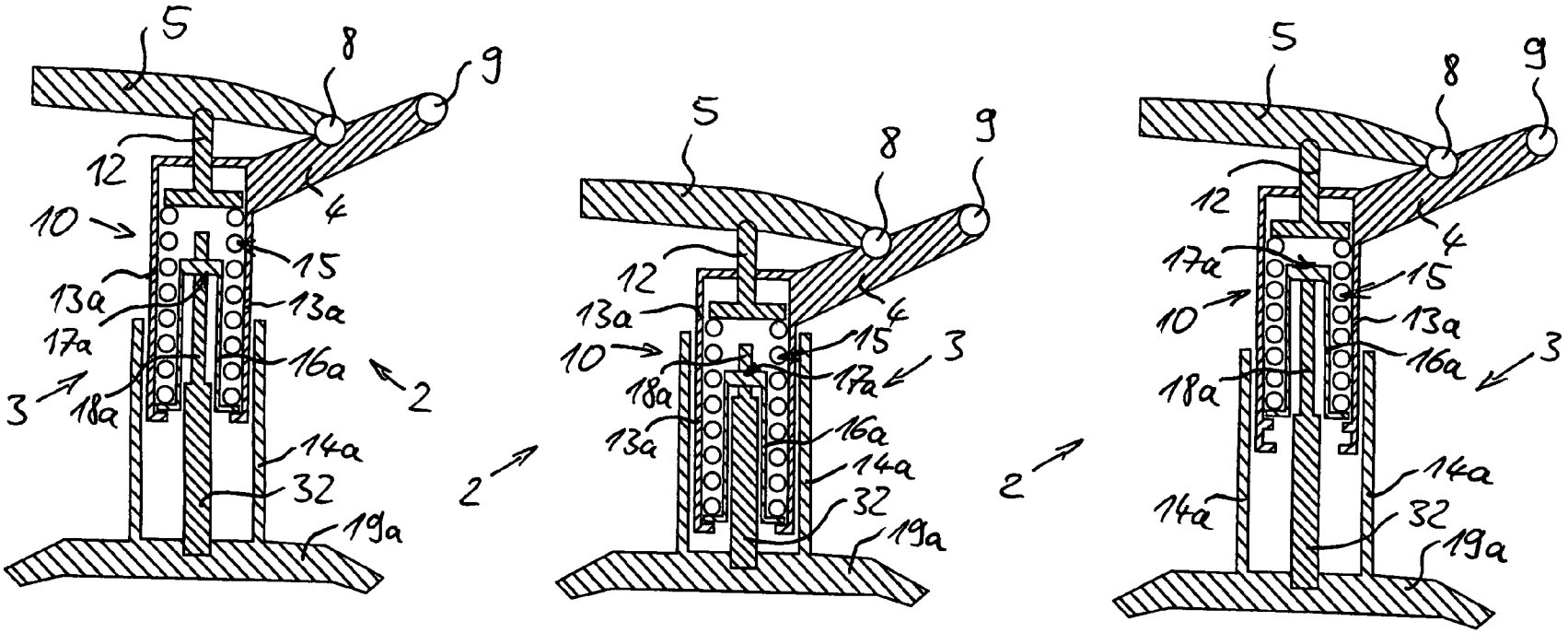
FIGS. 7 to 9 are schematic side views of an embodiment of a bottom chair part modified relative to the embodiment from FIGS. 1 to 6 shown in various functional positions.

FIGS. 7 to 9 show an alternative configuration of the chair 1 according to the invention relative to the configuration in FIGS. 1 to 6 in different variants of the adjustability of the chair 1. In this configuration, the chair 1 has a column base **19*a*, which is connected to a lower column part 14*a* and also to a spring element arranged in the lower column part 14*a* and formed by a gas spring 32. Furthermore, an upper column part 13*a* connected to the seat support 4 is provided with a spring 10 located therein. The synchronizing spring 10 is supported on the bottom side on a thrust support 16*a* connected to a piston rod of the gas spring 32 and on the top side receives force from the backrest support 5 by means of a plunger 12. By adjusting the thrust support 16*a* on the piston rod, for example, by means of a threaded connection made from a threaded bolt 18*a* connected to the piston rod and a threaded bore hole 17*a* in the thrust support 16*a*, the spring biasing of the spring 10** can be adjusted.

The upper column part **13*a* extends partially into the inner cavity of the lower column part 14*a* like a telescope to different degrees according to the functional position. The hat-like thrust support 16*a* has a threaded bore hole 17*a*, in which the piston rod engages on the top free end of the gas spring 32. The gas spring 32 within the lower column part 14*a* extends partially from below into the inner cavity of the hat-like thrust support 16*a* according to the height adjustment and cushioning of the gas spring 32**.

For easy movement of the chair 1, the column base 19 has a rolling base 28 with five rollers 29 (two of these are hidden), as can be seen in FIGS. 1 and 2.

The invention claimed is:

1. A chair (1), comprising a bottom chair part (2) having a column (3), with a seat support (4) held on the bottom chair part (2), a seat (6) connected pivotably to the seat support (4), and a backrest support (5) holding a backrest (7) and connected pivotably to the seat support (4), wherein movement of the seat (6) is coupled to movement of the backrest support (5) by a synchronizing mechanism having at least one spring device (10) and coupling elements, movement of the coupling elements of the synchronizing mechanism relative to each other can be blocked by a locking device (25), the locking device (25) is adjustable between a released position and a locked position, the synchronizing mechanism is located essentially within the column (3), a column base (19*a*) is connected to a lower column part (14*a*) of the column (3) and also to a spring element arranged in the lower column part (14*a*) formed by a gas spring (32), for adjusting seat height, and an upper column part (13*a*) that is connected to the seat support (4) is provided with the at least one spring device located therein, which is supported on a bottom side by a thrust support (16*a*) connected to a piston rod of the gas spring (32), the piston rod of the gas spring (32) comprises, on a top end thereof, a threaded bolt (18*a*) or is connected to a threaded bolt (18*a*) and the thrust support (16*a*) for the spring has a threaded bore hole (17*a*) screwed onto the threaded bolt (18*a*) for adjustment of the spring bias of the at least one spring device (10), and receives force on a toy side from the backrest support (7), via a plunger (12), and the upper column part (13*a*) extends telescopically at least partially into an inner cavity of the lower column part (14*a*).

2. The chair according to claim 1, wherein the coupling elements includes a sleeve-shaped end (11) of the seat support (4) engaging in a top end of the column (3), a plunger (12) receiving force from the backrest support (5) and projecting through the sleeve-shaped end (11) of the seat support (4), and a connection element (31) connecting the seat (6) and the backrest support (5) located at a distance to a pivot bearing (8) that pivotally connects the seat support (4) and the backrest support (5) in an articulated way, and the synchronizing spring device (10) receives force from the plunger (12) and the lower free end (11) of the seat support (4) engaging in the column (3).

3. The chair according to claim 1, wherein the synchronizing spring device (10) has at least one spring element supported on a thrust support.

4. The chair according to claim 1, wherein the spring element comprises at least one of a coil spring (15), a torsion spring, a plastic spring, or a gas spring.

5. The chair according to claim 1, wherein the column (3) comprises an upper column part (13) with the spring device (10) that is adjustable and a lower column part (14) arranged coaxial to the upper column part with a height adjustment, the two column parts (13, 14) are connected to each other so that they can be adjusted relative to each other, and rotating of the upper column part (13) relative to the lower column part (14) can be blocked by a locking device (22) for height adjustment and can be released for adjusting a spring biasing.

6. The chair according to claim 5, wherein the spring device (10) comprises a coil spring (15) arranged between the coupling element and a thrust support, the thrust support is locked in rotation with the upper column part (13) and has a threaded bore hole (17), in which a threaded bolt (18) locked in rotation with the lower column part (14) engages.

7. A chair (1), comprising a bottom chair part (2) having a column (3), with a seat support (4) held on the bottom chair part (2), a seat (6) connected pivotably to the seat support (4), and a backrest support (5) holding a backrest (7) and connected pivotably to the seat support (4), movement of the seat (6) is coupled to movement of the backrest support (5) by a synchronizing mechanism having at least one spring device (10) and coupling elements, the synchronizing mechanism is generally located within the column (3), the column (3) comprises an upper column part (13) with the spring device (10) that is adjustable and a lower column part (14) arranged coaxial to the upper column part with a height adjustment, the two column parts (13, 14) are connected to each other so that they can be adjusted relative to each other, and rotating of the upper column part (13) relative to the lower column part (14) can be blocked by a locking device (22) for height adjustment and can be released for adjusting a spring biasing, the chair (1) has a column base (19), which extends at least partially into the lower column part (14) and has a threaded rod (20) on a top end of the column base, and a threaded nut (21) locked in rotation with the lower column part (14) is screwed onto the threaded rod (20) for adjusting the height of the chair (1).

8. The chair according to claim 3, wherein the thrust support for the spring element comprises a spring plate (16).

9. The chair according to claim 1, wherein the thrust support for the spring (15) comprises a spring plate (16*a*) arranged downwards relative to a screw connection thereof with the threaded bolt (18*a*).

10. The chair of claim 3, wherein the thrust support is adjustable.

* * * * *